US005480081A

United States Patent [19]

Wilson et al.

[11] Patent Number: 5,480,081

[45] Date of Patent: Jan. 2, 1996

[54] SCORING AND BREAKING DEVICE WITH A CARRYING CASE THEREFOR

[75] Inventors: Kevin R. Wilson, Blue Springs, Mo.; Mitchell H. Babkes, Wichita, Kans.

[73] Assignee: Diamant Boart, Inc., Kansas City, Mo.

[21] Appl. No.: 126,355

[22] Filed: Sep. 24, 1993

[51] Int. Cl.[6] ..... B28D 1/24

[52] U.S. Cl. ..... 225/96.5; 83/886; 125/23.02

[58] Field of Search ..... 225/96.5; 125/23.01, 125/23.02; 83/886

[56] References Cited

U.S. PATENT DOCUMENTS

| | | | |
|---|---|---|---|
| 2,541,708 | 2/1951 | Marus | 125/23.02 |
| 3,567,086 | 3/1971 | Wark et al. | 225/96.5 X |
| 3,592,370 | 7/1971 | Boardman | 225/96.5 X |
| 3,889,862 | 6/1975 | Insolio et al. | 225/96.5 |
| 4,026,262 | 5/1977 | Yasuga | 125/23.02 |
| 4,046,299 | 9/1977 | Swartzfager | 225/3 |
| 4,693,232 | 9/1987 | Yasuga | 125/23.02 |
| 4,922,886 | 5/1990 | Hepworth | 125/23.01 |
| 5,040,445 | 8/1991 | Liou | 225/96.5 X |
| 5,169,045 | 12/1992 | Liu | 225/96.5 |

FOREIGN PATENT DOCUMENTS

| | | |
|---|---|---|
| 212224 | 3/1957 | Australia . |
| 869670 | 12/1978 | Belgium . |
| 0052691 | 6/1982 | European Pat. Off. . |
| 0255460 | 2/1988 | European Pat. Off. . |
| 0277827 | 8/1988 | European Pat. Off. . |
| 0299501 | 1/1989 | European Pat. Off. . |
| 0337278 | 10/1989 | European Pat. Off. . |
| 0397367 | 11/1990 | European Pat. Off. . |
| 0424575 | 5/1991 | European Pat. Off. . |
| 0428070 | 5/1991 | European Pat. Off. . |
| 0490268 | 6/1992 | European Pat. Off. . |
| 0501053 | 9/1992 | European Pat. Off. . |
| 781433 | 5/1935 | France . |
| 2169681 | 9/1973 | France . |
| 2169682 | 9/1973 | France . |
| 2213653 | 8/1974 | France . |
| 2294029 | 7/1976 | France . |
| 2328554 | 5/1977 | France . |
| 2399906 | 3/1979 | France . |
| 2444547 | 7/1980 | France . |
| 2457359 | 12/1980 | France . |
| 2456716 | 12/1980 | France . |
| 2462244 | 2/1981 | France . |
| 2474930 | 8/1981 | France . |
| 2490541 | 3/1982 | France . |
| 2504845 | 11/1982 | France . |
| 2542248 | 9/1984 | France . |
| 2553024 | 4/1985 | France . |
| 2587647 | 3/1987 | France . |
| 2600583 | 12/1987 | France . |
| 2644096 | 9/1990 | France . |
| 2661637 | 11/1991 | France . |
| 1235792 | 3/1967 | Germany . |
| 2556094 | 10/1976 | Germany . |
| 2545900 | 4/1977 | Germany . |

(List continued on next page.)

*Primary Examiner*—Richard K. Seidel
*Assistant Examiner*—Raymond D. Woods
*Attorney, Agent, or Firm*—Kokjer, Kircher, Bowman & Johnson

[57] ABSTRACT

A tile cutting apparatus includes a unit base for holding a tile and guide rods above and running parallel to the base. The guide rods carry a scoring/breaking assembly along a scoring and breaking path. The base includes, on its upper surface, a breaker spline inserted therein and extending along the scoring path. The base's upper surface also includes resilient pads supporting stainless steel rest plates on both sides of the breaker spline. The spline is oriented at a slight angle with respect to the surface of the rest plates to facilitate breaking. The scoring/breaking assembly includes a spring for applying constant pressure to a cutting wheel throughout the scoring operation. The scoring/breaking assembly is constructed such that a single handle allows the user to engage and disengage the cutting wheel, score the tile while maintaining a constant scoring pressure and break the tile. The apparatus includes a molded cover and base that minimize excess assembly and parts.

33 Claims, 4 Drawing Sheets

U.S. PATENT DOCUMENTS

| | | |
|---|---|---|
| 2716085 | 10/1978 | Germany . |
| 2902497 | 8/1979 | Germany . |
| 2814835 | 10/1979 | Germany . |
| 2855649 | 7/1980 | Germany . |
| 8715018 | 12/1987 | Germany . |
| 3702239 | 8/1988 | Germany . |
| 8906331 | 7/1989 | Germany . |
| 8911525 | 11/1989 | Germany . |
| 8914776 | 3/1990 | Germany . |
| 9107581 | 8/1991 | Germany . |
| 9111400 | 11/1991 | Germany . |
| 9200829 | 4/1992 | Germany . |
| 0180471 | 11/1973 | Spain . |
| 0205027 | 9/1974 | Spain . |
| 0230395 | 8/1977 | Spain . |
| 0235479 | 10/1978 | Spain . |
| 0235575 | 10/1978 | Spain . |
| 0235577 | 10/1978 | Spain . |
| 0235576 | 10/1978 | Spain . |
| 0241777 | 3/1979 | Spain . |
| 0247825 | 3/1979 | Spain . |
| 0259289 | 7/1981 | Spain . |
| 0272903 | 6/1983 | Spain . |
| 9100016 | 1/1991 | Spain . |
| 932640 | 7/1963 | United Kingdom . |
| 1327119 | 8/1973 | United Kingdom . |
| 1351173 | 4/1974 | United Kingdom . |
| 1481135 | 7/1977 | United Kingdom . |
| 1509776 | 5/1978 | United Kingdom . |
| 1548013 | 7/1979 | United Kingdom . |
| 2021036 | 11/1979 | United Kingdom . |
| 2040793 | 9/1980 | United Kingdom . |
| 2063149 | 6/1981 | United Kingdom . |
| 2091163 | 7/1982 | United Kingdom . |
| 2111901 | 7/1983 | United Kingdom . |
| 2131345 | 6/1984 | United Kingdom . |
| 2132937 | 7/1984 | United Kingdom . |
| 2135931 | 9/1984 | United Kingdom . |
| 2185115 | 7/1987 | United Kingdom . |
| 2189188 | 10/1987 | United Kingdom . |
| 2197614 | 5/1988 | United Kingdom . |
| 2208365 | 3/1989 | United Kingdom . |
| 2224689 | 5/1990 | United Kingdom . |
| 2238392 | 5/1991 | United Kingdom . |
| 9116184 | 10/1991 | WIPO . |
| 9211985 | 7/1992 | WIPO . |

SCORING AND BREAKING DEVICE WITH A CARRYING CASE THEREFOR

BACKGROUND OF THE INVENTION

1. Field of the Invention

The present invention relates in general to a scoring and breaking machine. In particular, the present invention relates to a tile scoring machine which maintains constant pressure upon the cutter wheel throughout the scoring operation and that achieves a sharp break even on soft tile.

2. Description of the Related Art

The general purpose of a scoring and breaking device is to provide a tool by which a user may break a material, such as tile, glass, plastic, ceramic, etc., along a desired line. By breaking the material, the user avoids the difficult task of cutting an often extremely hard material. The break is guided along a desired line by first scoring or cutting a slight groove in the material along this line.

Conventional scoring and breaking devices have been provided for cutting tile that comprise a base for holding a tile and one or more guide rods aligned parallel thereto. The guide rods slidably support a tile cutter and guide the cutter across the tile. The tile cutter is connected to a handle that the operator uses to force the cutter across the tile.

One type of conventional tile cutter (e.g., U.S. Pat. No. 4,026,262) utilizes the handle as a lever arm, by which the operator applying a scoring pressure to the cutter. The operator varies the scoring pressure on the cutter by varying the torque on the handle. However, this arrangement is disadvantageous since operators inadvertently vary the scoring pressure. Typically, the user grows fatigued after several scoring operations since the user must apply a large scoring force during each operation. Also, users develop muscle cramps as the scoring motion is awkward. Consequently, the depth of the score is uneven or otherwise improper, causing an uneven break.

Further, the system of the '262 patent is exclusively a tile cutter and thus requires a separate mechanism to break the tile. In this conventional system, to score a tile the user must pull the scoring tool across the tile. This pulling action is disadvantageous since it requires a stronger grip and quickly fatigues the user's forearm. Instead, it is preferential for the user to push the scoring tool across the tile. By pushing the tool, the user is able to push against the handle of the tool with the palm of the user's hand, thereby requiring less wrist strength. This motion requires less energy.

An alternative system (e.g., British Patent No. 932,640) combines the cutting and breaking operations within a single apparatus. However, this system employs compound lever arms to perform cutting and breaking. Specifically, it connects a tile cutter and a tile breaking member to the operator's handle via separate rods. As the handle moves through a first portion of a stroke, a first linking rod drives the cutter across the tile to effect a score. As the handle moves through a second portion of the stroke, a second linking rod forces the breaking member downward against the tile to effect a break.

The cutter in this alternative conventional system includes a spring to maintain pressure on the scoring wheel at all times. The scoring wheel and spring are slidably housed within a hollow screw threaded into the cutter housing. The scoring wheel is attached to a small threaded rod extending through the spring and beyond the top of the hollow screw. A nut on this threaded rod is used to adjust the tension of the spring, while the hollow screw is used to adjust the depth of the score.

However, the continuous pressure of the spring directly on the scoring wheel necessitated a complex mechanism for adjusting the scoring depth for tiles having different thicknesses. Also, when it is desirable to move the cutter across the tile without scoring, the screw must first be substantially unscrewed.

Another conventional system (U.S. Pat. No. 3,889,862) has been proposed which performs the cutting and breaking operations. This system includes multiple springs, each of which exerts a different amount of force upon a scoring wheel in order to provide different scoring pressures for various kinds of materials to be cut. The stiffest spring is manually engaged and disengaged with a bayonet lever to permit this stiffest spring to function only when cutting plastic. Another lever is provided to raise the scoring wheel to an inactive position when moving the scoring head between scores. A third lever is provided to push the cutting wheel across the tile, while a fourth lever is provided to force the breaker bar against the tile. However, this system is unduly complex as it requires the use of multiple levers and multiple springs.

Further, with regard to the breaking operation, conventional systems have provided various base plates that support the tile during breaking. One conventional system (British Patent No. 932,640) utilizes, as a base, an inverted V-shaped anvil aligned below and parallel to the path of the scoring wheel. The scoring mark on the tile is aligned parallel to, and directly above, the apex of the anvil to effect a break. Another system (U.S. Pat. No. 3,889,862) utilizes an anvil having two slightly inclined sides which define an apex that designates the line of the score or cut. In this second system, the anvil includes, along its apex, a slight notch or depression to avoid contact with the cutting wheel. However, these conventional systems do not provide a sufficiently clean break as the tile will chip off along either side of the break or the break will not precisely follow the scoring path.

Accordingly, the need remains for a tile scoring and breaking tool having improved features and operating techniques to address the problems and drawbacks heretofore experienced with earlier devices. The primary objective of this invention is to meet this need.

SUMMARY OF THE INVENTION

More specifically, it is an object of the present invention to provide an inexpensive and simple machine for reliably performing tile scoring and breaking operations.

Further, it is an object of the present invention to provide a system that allows the user, via a single handle, to engage and disengage the cutter, perform a scoring operation and subsequently, perform a breaking operation.

It is a further object of the present invention to maintain a constant pressure upon the scoring wheel throughout the scoring operation by providing a biasing spring within the cutter head.

It is a further object of the present invention to maintain the handle at an optimal angle with respect to the tile surface, independent of tile thickness, to direct a maximum percentage of a user's force applied to the handle along a scoring path.

It is a further object of the present invention to provide clean breaks, even on soft tile, by aligning a full length breaker spline having a relatively sharp edge at a slight angle with respect to the tile support, such that the breaker spline is seated, at a break initiating point, substantially flush with the outer surface of the tile support.

It is a further object of the present invention to facilitate breaks by providing resiliently compressible pads on both sides of the breaker spline, the pads compressing during a break to expose the breaker spline.

It is a further object of the present invention to prevent tile chips from embedding in the compressible pads by covering these pads with stainless steel rest plates.

It is a further object of the present invention to facilitate breaking by positioning a breaker bar in front of the scoring wheel, thereby allowing the breaker bar to get closer to the tile's edge, and by providing a shearing action along the break by slightly inclining the breaker spline in a direction parallel to the scoring line.

It is a further object of the present invention to provide a base and cover which are molded, such that the base of the scoring machine doubles as the bottom of a carrying case, while the cover includes snap retainers for holding extra tools.

It is a further object of the present invention to provide a breaker spline that is snappingly engaged into the unit base to facilitate easy replacement thereof.

It is a further object of the present invention to allowing scoring to made at an infinite number of angles upon a tile and to set rigidly the scoring angle.

It is a further object of the present invention to accept and orient large tiles at an infinite number of scoring angles.

These and other objects are achieved by providing a tile cutting apparatus that includes a unit base for holding a tile and guide rods above and running parallel to the base. The guide rods carry a scoring/breaking assembly along a scoring and breaking line. The base includes, on its upper surface, a breaker spline inserted therein and extending along the scoring line. The base's upper surface also includes resilient pads supporting stainless steel rest plates on both sides of the breaker spline. The spline is oriented at a slight angle with respect to the surface of the rest plates to facilitate breaking. The scoring/breaking assembly includes a spring for applying a constant pressure to a cutting wheel throughout the scoring operation. The scoring/breaking assembly is constructed such that a single handle allows the user to engage and disengage the cutting wheel, score the tile while maintaining a constant scoring pressure and break the tile. The apparatus includes a molded cover and base that minimize excess assembly and parts.

BRIEF DESCRIPTION OF THE DRAWINGS

The objects and features of the invention noted above are explained in more detail with reference to the drawings, in which like reference numerals denote like elements, and in which.

DETAILED DESCRIPTION OF THE INVENTION

Hereafter, the construction of the instant invention will be described, followed by an explanation of the operation thereof.

Figure 1:
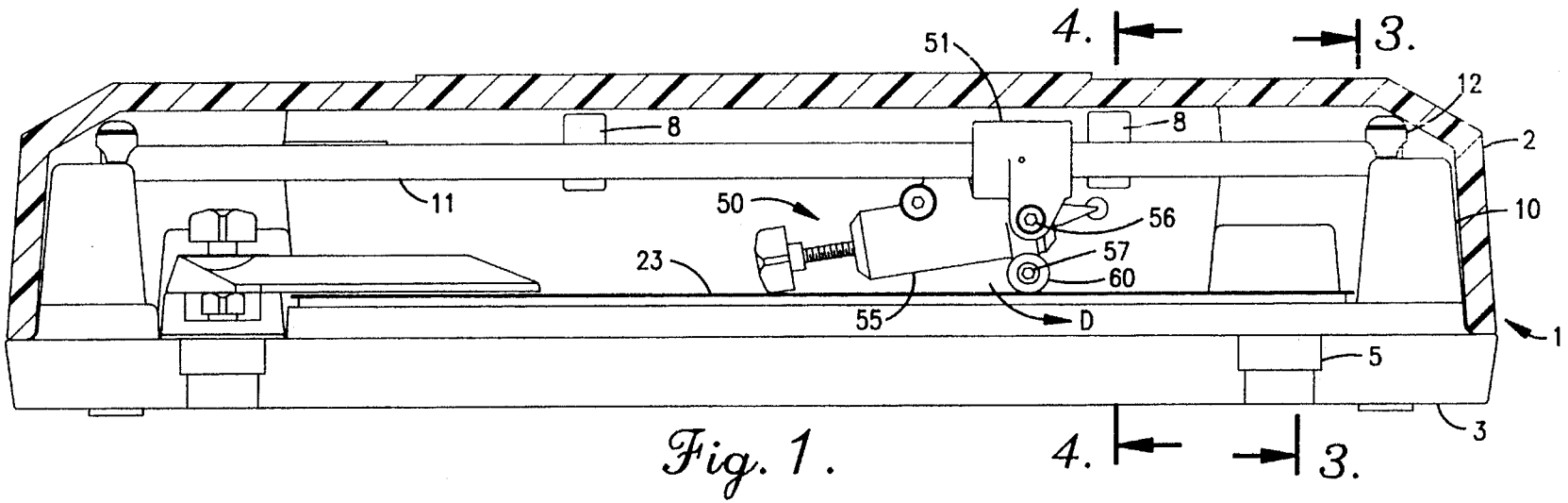
FIG. 1 is a side sectional view of the invention with the cover fastened to the base and the cutting assembly in a storage position.
Figure 4:
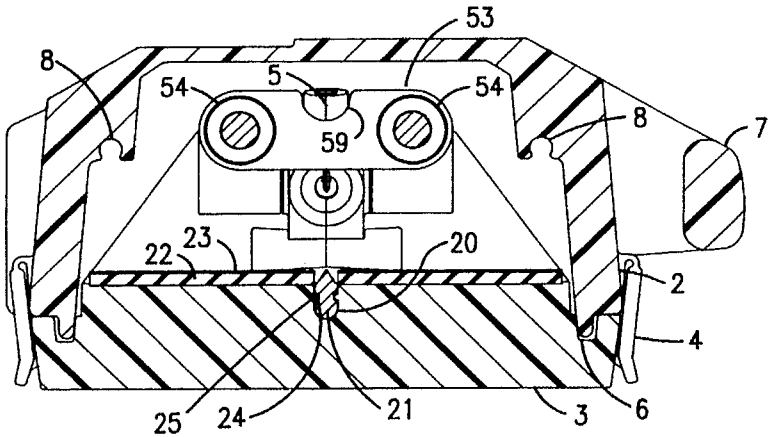
FIG. 4 is an end sectional view of the invention, taken along line 4—4 of FIG. 1 in the direction of the arrows, with the cover fastened to the base.
Figure 3:
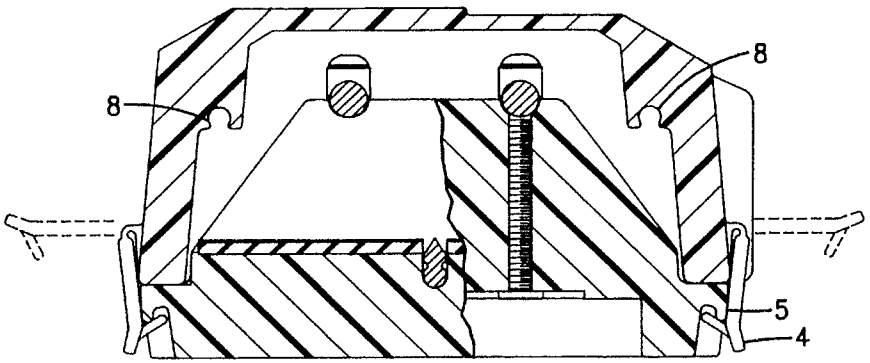
FIG. 3 is an end sectional view of the invention, taken along line 3—3 of FIG. 1 in the direction of the arrows, with the cover fastened to the base.
Figure 11:
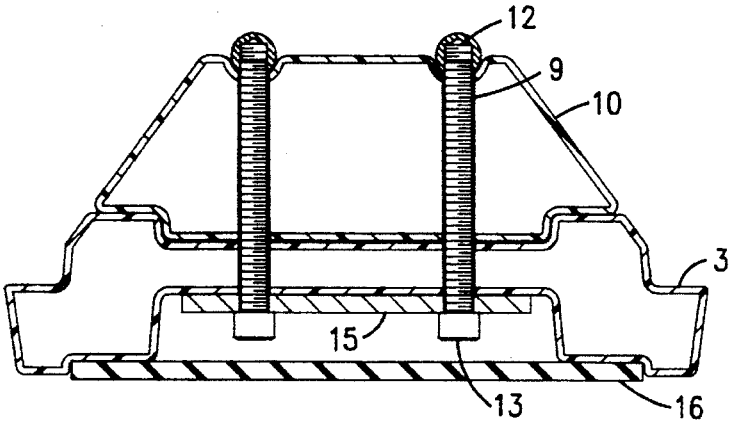
FIG. 11 is an end sectional view of the invention, through the base and support bracket, taken along line 11—11 of FIG. 7 in the direction of the arrows showing an alternative embodiment in which the base and support brackets are hollow.

FIG. 1 illustrates the overall tile cutter assembly 1 which includes a cover 2 and a base 3 that interconnect with latches 4 (FIG. 3) and latch keepers 5 to form the carrying case for the tile cutter. The cover 2 and base 3 are molded from high density polyethylene and may be solid (as illustrated in FIGS. 3 and 4) or hollow (as illustrated in FIG. 11). If formed hollow, the base is filled with a dense structural foam to add rigidity.

Referring to FIGS. 3, and 4, the base 3 includes indentations 6 (FIG. 4) to provide additional support for the cover 2. The cover 2, latches 4 and a carrying case handle 7 are molded separately and snapped to the cover 2. Optionally, the latches 4 and carrying case handle 7 are molded as part of the cover 2 to minimize assembly and the separate inventory of parts. The cover 2 includes snap-in/out retainers 8 (FIG. 3) molded within its interior to provide storage space for a scoring/breaking handle 70 (FIG. 8), extra cutting wheels and replacement tools. The latch keepers 5 are molded into the base 3 to hold the cover 2. The latches 4 and latch keepers 5 are symmetrically positioned to permit the cover 2 to be installed in either direction. As illustrated in FIG. 1, during storage, a scoring/breaking assembly 50 "locks" into a storage position by frictionally engaging a breaker bar 60 and a rest plate 23 to prevent sliding while in transit.

Figure 8:
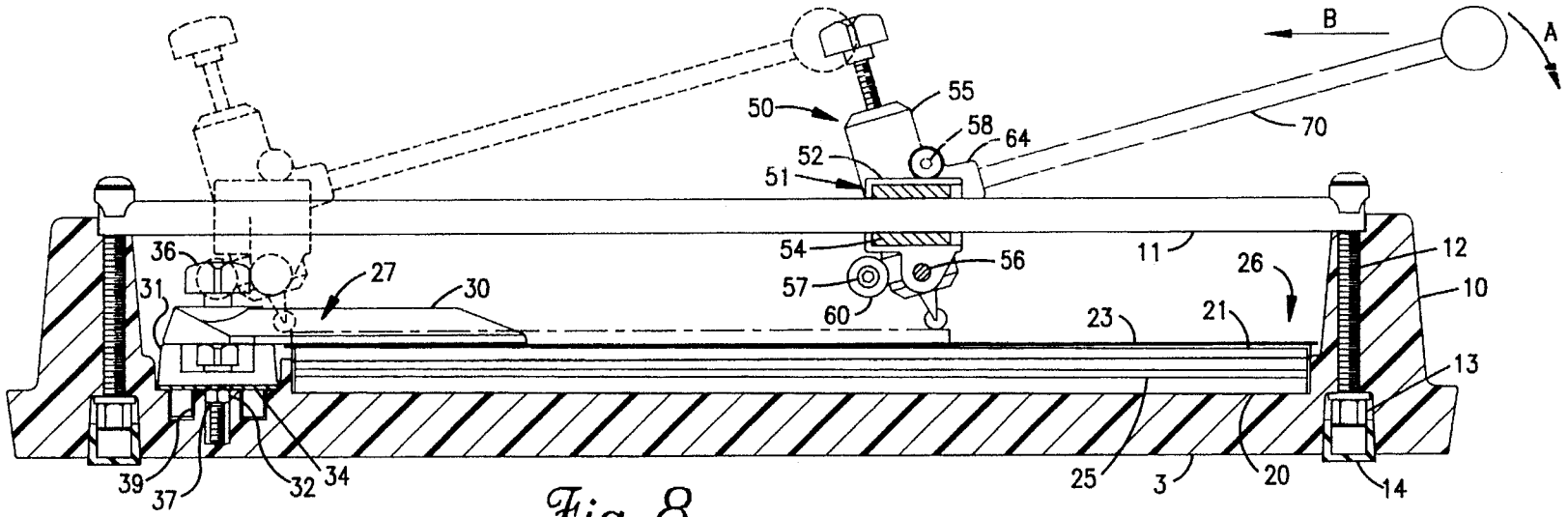
FIG. 8 is a side sectional view of the invention, through the base unit and support assembly, with the cutting assembly at the beginning of the scoring stroke shown in full lines and at the end of the scoring stroke shown in broken lines.

As illustrated in FIG. 8, the base 3 of the tile cutter doubles as the bottom of the carrying case, and thus, the operator need only remove the cover 2 before using the cutter. The base 3 includes support brackets 10 on opposite ends thereof which support guide rods 11. The guide rods are connected to the base via bolts 12. The support brackets 10 are molded and may be formed from solid material and integral with the base (as illustrated in FIG. 8). Thus, the guide rods 11 are connected to the base via bolts 12 and nuts 13. Rubber extrusions 14 are affixed to the lower side of the base 3 to cover the nuts 13 and to support the device during operation.

FIG. 11 illustrates an alternative embodiment for the base and support bracket structure. In this alternative embodiment, the base 3 and the support brackets 10 are hollow and are formed separate from one another. Additional steel sleeves 9 are provided within the hollow support brackets 10 to surround the bolts 12 and support the guide rods 11. The sleeves 9 compensate for the loss in structural integrity causes by the use of hollow support brackets 10 and base 3. A plate 15 is placed between the base 3 and nuts 13 to distribute the force of the nuts 13 evenly over the base 3. Thus, the guide rods 11 are connected to the base 3 via bolts 12, sleeves 9, plate 15 and nuts 13. A rubber pad 16 is affixed to the lower side of the base 3 to cover the nuts 13 and to support the device during operation.

As illustrated in FIG. 4, the upper surface of the base 3 includes a central groove 20, running a length thereof, which receives a breaker spline 21. On opposite sides of the groove 20, a resilient pad 22 is adhesively affixed to the upper side of the base 3 and a stainless steel rest plate 23 is adhesively fastened to the resilient pad 22. The breaker spline 21 includes slots 24 along opposite sides thereof, which snappably engage corresponding ridges 25 formed in the groove 20. The slots 24 and ridges 25 allow the breaker spline 21 to be replaced quickly. Once inserted, as viewed from above (FIG. 5), the breaker spline 21 extends in a direction parallel to, and along the length of, the scoring path. As viewed from the side (FIG. 8), the breaker spline 21 extends at a slight angle to the surface of the steel rest plate 23. More directly, at the break initiating end 27 (FIGS. 7 and 8), the top edge of the breaker spline 21 is substantially flush with or slightly lower than the top surface of the rest plate 23, while at the score initiating end 26 (FIG. 8), the top edge of the breaker spline 21 is 1½°–3° below the top surface of the breaker spline 21 at the break initiating end 27.

Figure 2:
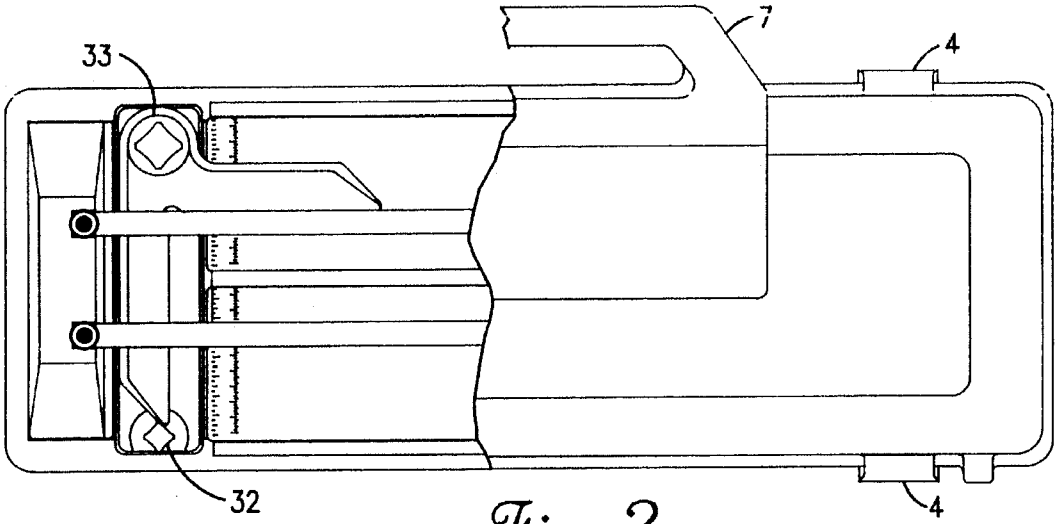
FIG. 2 is a top sectional view of the invention with the cover fastened to the base and the cutting assembly in a storage position.
Figure 5:
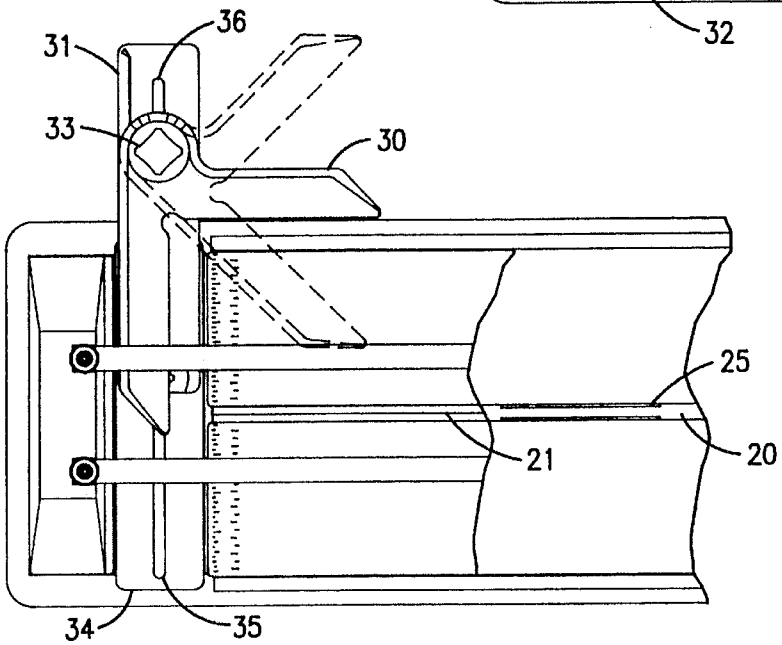
FIG. 5 is a top sectional view of a portion of the invention with a broken line therethrough, showing on one side a miter guide base and miter guide arm and showing on an opposite side the central groove and ridges that engage the spline.
Figure 9:
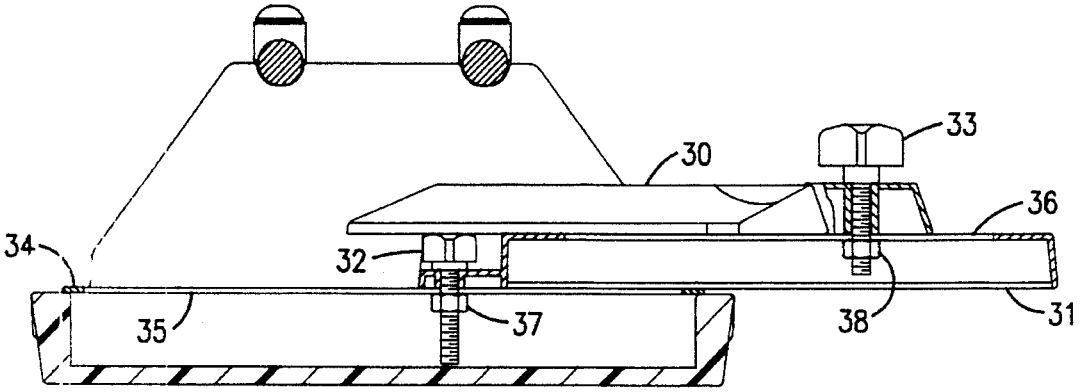
FIG. 9 is an end sectional view of the invention, through the base and center head, taken along line 9—9 of FIG. 7 in the direction of the arrows showing the breaking operation at a breaking initiating end.

Referring to FIGS. 2, 5, and 8, a miter guide arm 30 and a miter guide base 31 are bolted separately to one end of the base 3 with thumb screw knobs 32 and 33, respectively. The thumb screw knobs 32 and 33 allow the guide base 31 and guide arm 30 to be adjusted and set at any desired angle. Specifically, the guide base 31 rests on a guide plate 34 having protrusions 39 (FIG. 8) that are pressed or snapped into recesses in the base 3 to maintain the guide plate 34 in a fixed relation thereto. Optionally, an alternative securing means, such as expandable tubing, may be substituted for the guide plate 34. The base 3 also includes an elongated recess aligned parallel to and directly below a slot 35 in the guide plate 34 (FIGS. 5 and 9). The thumb screw 32 extends through and slides along the slot 35, and engages a jam nut 37 (FIGS. 8 and 9), which moves within the elongated recess in the base 3. Tightening the thumb screw 32 and jam nut 37 secures the guide base 31 to the guide plate 34 and base 3.

The guide arm 30 includes a hole through which the second thumb screw 33 extends. This second thumb screw 33 extends through a slot 36 in the guide base 31 and engages a second jam nut 38, which moves along the slot 36 and within the guide base 31. When the second thumb screw 33 and jam nut 38 are tightened, they secure the guide arm 30 to the guide base 31. In this manner, the guide base 31 allows the guide arm 30 to extend to the right or left to accept large tiles. The guide arm 30 rotates in a protractor-like manner and allows the tile to be set at an infinite number of angles. The guide arm 30 and guide base 31 are secured at any desired angle.

Figure 7:
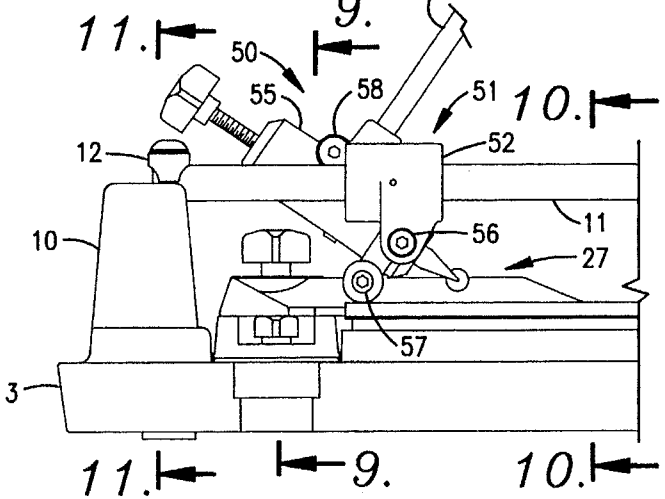
FIG. 7 is a side sectional view of the invention, through the cutting assembly, during a breaking operation.
Figure 6:
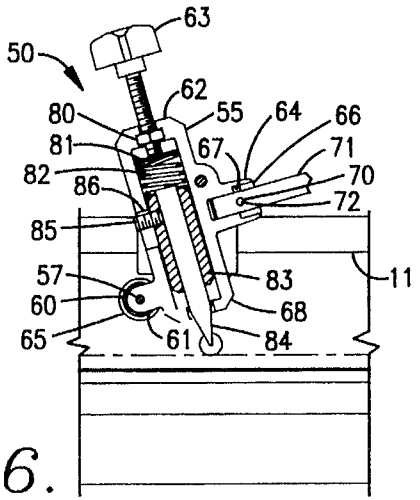
FIG. 6 is a side sectional view of the invention, through the cutting assembly, during a cutting operation.

FIGS. 6–8 illustrate the pair of guide rods 11 that are bolted, via the support brackets 10, to the base 3. The guide rods 11 are aligned parallel to the breaker spline 21 and slidably support a scoring/breaking assembly 50. The scoring/breaking assembly 50 includes, and is supported by, a center track 51 (FIG. 7) which includes two cylindrical guides 52 having recesses therein. Two linear bearings 54 fit within the recesses in the center track 51 and are held in place with set screws (not shown). The linear bearings 54 allow the scoring/breaking assembly 50 to slide along the guide rods 11 during a scoring operation. The guides 52 are joined with a cross member 53 (FIG. 4). An upper side of the cross member 53 includes a half-moon shaped notch 59 (FIG. 4) that functions as a stop for the handle 70 (this operation is described below in detail).

Referring to FIG. 7, the scoring/breaking assembly 50 also includes a center head 55 which is pivotally mounted, on opposite sides thereof, to the center track 51, via shoulder screws 56. These shoulder screws 56 allow the center head 55 to be pivoted between a scoring position (FIG. 6) and a breaking position (FIG. 7). The center head 55 is split into two halves (along line S illustrated in FIG. 4) that are bolted together via screws 57 and 58.

Referring to FIG. 6, the center head 55 includes a toe member 61 containing a breaker bar 60, a top 62 that receives a thumb screw knob 63 and a back member 64 that is recessed to hold the handle 70. Optionally, the breaker bar 60 is covered with a resilient sleeve 65, retained by the screw 57, to prevent scratching of the tile surface. The resilient sleeve 65 may be aluminum or plastic or any similar material. The handle 70 includes, at its lower end, a hole 71 therethrough containing a pressed rolled pin 72 extending beyond both sides of the handle 70. The recess within the back member 64 of the center head includes a notch 66, on opposite sides thereof, to receive the tips of the rolled pin 72. The notch 66 opens into a retaining groove 67. The handle 70 is held within the back member 64 by inserting the tips of the rolled pin 72 into the notch 66 and twisting the handle 70, thereby turning these tips into the retaining groove 67.

Figure 10:
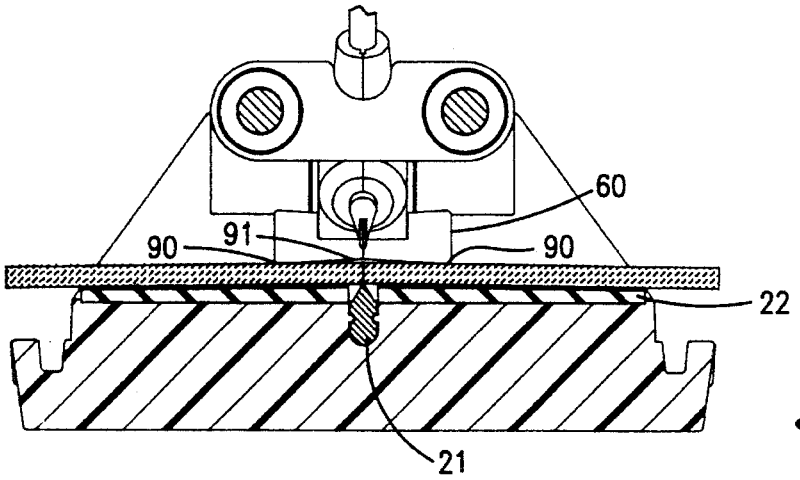
FIG. 10 is an end sectional view of the invention, through the base, taken along line 10—10 of FIG. 7 in the direction of the arrows showing the breaking operation at an intermediate point between the score initiating end and the break initiating end.

As illustrated in FIG. 10, the breaker bar 60 includes a tapered bearing surface which unevenly contacts the tile. This tapered bearing surface is formed in an inverted V-shape, whereby only the outer edges 90 of the breaker bar initially contact the tile. The center 91 of the tapered surface does not contact the tile until the tile is partially broken and bent to the contour of the tapered bearing.

As illustrated in FIG. 6, when bolted together, the two halves of the center head 55 form a hollowed cavity therebetween. This cavity retains a jam nut 80, a washer 81, a compression spring 82, a hollow tool holder 83 and a scoring wheel 84. The thumb screw 63 is threaded through the jam nut 80 and abuts against the washer 81 which contacts the top of the spring 82. As the thumb screw 63 is screwed into the center head 55, the washer 81 compresses the spring 82. The spring 82 forces the tool holder 83 downward. A set screw 85, threaded through the tool holder 83, indirectly locks the scoring wheel 84 to the tool holder 83. Thus, the spring 82 forces the scoring wheel 84 downward. The set screw 85 is inserted into the tool holder 83 through a slot 86 in the face of the center head. Once assembled, a bottom lip 68 on both halves of the center head 55 prevents the tool holder 83 from being forced out through the bottom of the center head 55 by the spring 82.

Next, the operation of the present invention will be described.

During storage, a scoring/breaking assembly 50 "locks" into a storage position by frictionally engaging (FIG. 1) a breaker bar 60 and a rest plate 23 to prevent sliding while in transit. As illustrated in FIG. 1, the breaker bar 60 rotates in the direction of arrow D until the center of the screw 57 rotates past the center of the screw 58, thereby achieving a "cam locking" action between the center head 55 and the center track 51.

First, the user assembles the tile cutter and adjusts the depth and scoring pressure of the cutting wheel. To assemble the cutter, the user only need remove the cover 2 and unlock and attach the handle 70 to the scoring/breaking assembly 50 by inserting the rolled pin 72 into the notch 66 in the back member 64 of the center head 55. Once inserted, the user turns the handle 70 one-quarter of a turn, thereby engaging the rolled pin 72 into the retaining groove 67 to hold the handle 70 in place.

Then the user adjusts the scoring depth and scoring pressure according to the thickness and type of material to be cut. To change the scoring depth, the user loosens the set screw 85, moves the scoring wheel 84 to the desired height and retightens the set screw 85. The scoring wheel 84 is easily moveable since the compression spring 82 does not exert force directly on the scoring wheel 84, but instead, applies its force to the hollow tool holder 83. While adjusting the scoring depth, the tool holder 83 contacts and is supported by the bottom lip 68 of the center head 55. The scoring depth is preset in this manner in order that tiles having different thicknesses (e.g., ¼ inch, ⅜ inch, ½ inch) may be scored to different depths since, for a ¼ inch thick tile, the score should be shallower than for a ½ inch thick tile. Thus, the set screw 85 allows easy adjustment of the scoring depth.

To adjust the scoring pressure, the user screws the thumb screw 63 to a desired depth, thereby setting the compression of the spring 82 at a constant desired level. As the thumb screw 63 is screwed into the center head 55, it forces the washer 81 toward the tool holder 83 and compresses the spring 82. Conversely, as the thumb screw 63 is unscrewed, it allows the washer 81 to move away from the tool holder 83 and decompresses the spring 82. Once the scoring pressure is set, the user performs the scoring and breaking operations (as explained hereafter). If the tile does not break properly, the user tightens or screws down the thumb screw 63, to increase the pressure on the spring 82. This increased pressure provides a slightly deeper score in, and consequently an easier break of, the next tile. The user repeatedly adjusts the spring tension until a proper break is obtained.

Next, the user sets the scoring path with respect to the tile edge by adjusting the miter guide base 31 and miter guide arm 30. First, the screw knobs 32 and 33 are loosened and the guide base 31 and guide arm 30 are moved (FIG. 5) and then the screw knobs 32 and 33 are retightened. Next, the user holds a tile against the miter guide arm 30 and positions the scoring wheel 84 at the score initiating point 26. To engage the scoring wheel 84, the user pushes the handle 70 downward and forward whereby the back member 64 of the center head 55 seats and "bottoms out" in the notch 59 while pushing forward to make the scoring action.

By holding the back of the center head 55 against the cross member 53 throughout the scoring operation, the user maintains the center head 55 in the same position and orientation during every cut, thereby maintaining a definite distance between the bottom of the center head 55 and the tile surface. Consequently, the only factor that can change the scoring pressure while scoring is the compression on the spring 82. Accordingly, once the compression spring 82 is set, it maintains a constant pressure on the scoring wheel 84 throughout the scoring operation. The user pushes the scoring/breaking assembly 50 across the tile (along the direction shown by arrow B in FIG. 8) to score the tile.

Also, by holding the center head 55 against the cross member 53, the force exerted by the user is directed primarily along the scoring direction. Thus, when scoring a thick tile, the handle 70 is not maintained in a substantially upright position in which a large portion of the user's force is exerted downward (i.e., perpendicular to the scoring direction). Instead, regardless of the tile thickness, the handle 70 is always oriented (as illustrated in FIG. 8) to transfer an optimal amount of the user's force along a direction parallel to the scoring path.

After scoring the tile, the user positions the breaker bar 60 (FIGS. 7 and 10) directly above the outer edge of the tile at the break initiating end 27, and lifts up on the handle, thus forcing the breaker bar 60 against the tile. The breaker bar 60 is arranged on the front of the center head 55 in order that the breaker bar 60 should be positioned within ¼ score length of the end of the tile. In this manner, the smallest amount of lifting pressure will effect a clean break.

As illustrated in FIG. 10, the downward pressure created by the breaker bar 60 forces the resilient pad 22 to compress on both sides of the breaker spline 21 thereby causing the bottom surface of the tile to contact the leading edge of the breaker spline 21 at the break initiating point 27 (FIG. 7). Initially, only the outer edges 90 of the breaker bar 60 contact the tile, and thus forces the tile downward along opposite sides of the breaker spline 21. As illustrated in FIG. 10, these opposing forces cause the tile to compress the outer edges of the resilient pad 22 before compressing the central portion thereof. This action between the outer edges of the breaker bar 60 and breaker spline 21 initiates a break along the scoring path. In addition, the upward lifting motion of the handle 70 (FIG. 7) causes the breaker bar 60 to apply a force upon the tile along the direction in which the crack is propagating (i.e. along the scoring path). This force in the direction of the crack facilitates the break.

Moreover, the slight angular relation of the breaker spline 21 with respect to the surface of the steel rest plate 23, creates a "guillotine" or paper-cutter-like shearing action along the scoring path. Specifically, the breaker bar 60 starts the break at the outer edge of the tile since this is the first and sole portion of the tile touching the breaker spline 21. As the breaker bar 60 continues to press the tile further downward, the resilient pads 22 further compress exposing an additional portion of the breaker spline 21 to the tile. Thus, as the resilient pads 22 compress, the amount of contact between the tile and breaker spline 21 increases and extends along the scoring path.

The outer edge of the tile begins to crack shortly after the resilient pad 22 begins to compress, allowing the end of the tile nearest the break initiating end 27 to move downward over the breaker spline 21. As the tile moves downward the point of contact (i.e., the point breaker) between the unbroken tile and the breaker spline 21 moves along the scoring path until it reaches the end of the tile at which scoring initiated. This guillotine effect provides a very clean break even on soft tile. Optionally, the breaker bar 60 is covered with a resilient sleeve 65 to prevent scratching of the tile throughout the break. Any excess tile chips are easily brushed off the steel rest plate 23.

In summary, the above construction provides an inexpensive and simple structure for performing scoring and breaking operations. The instant scoring/breaking assembly 50 provides a single handle, to engage and disengage the cutter, score the tile while maintaining a constant pressure thereon and break the tile. By using a resilient pad 22 below the steel rest plate 23 and by orienting the breaker spline 21 at a slight angle to the scoring surface, the instant system provides clean breaks, even on soft tile. The present structure is simplified by molding the base and cover, such that the base may be hollow and doubles as the bottom of a carrying case and the cover includes snap retainers for holding extra tools. By positioning the breaker bar 21 in front of the scoring wheel 84, the score is effected by a pushing action while the breaker bar 60 is engaged by a lifting action. By holding the back member 64 against the cross member 53 during scoring, the compression spring 82 maintains a constant pressure on the scoring wheel.

From the foregoing it will be seen that this invention is one well adapted to attain all ends and objects hereinabove set forth together with the other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings 1–9 are to be interpreted as illustrative, and not in a limiting sense.

What is claimed is:

1. An apparatus for scoring and breaking a tile along a scoring path, said apparatus comprising:

a base for holding said tile during scoring and breaking operations;

at least one guide rod, supported by said base and extending in a direction parallel to said scoring path; and a scoring/breaking assembly that is slidably mounted on said at least one guide rod, said scoring/breaking assembly including:

a support member slidably mounted to said at least one guide rod, and;

a center head, pivotally mounted to said support member to rotate between scoring and breaking positions, for scoring and breaking said tile along said scoring path, said center head abutting against said support member when rotated to said scoring position, said support member maintaining said center head at a constant scoring orientation with respect to said at least one guide rod throughout said scoring operation.

2. An apparatus for scoring and breaking a tile according to claim 1, said scoring/breaking assembly further comprising:

a cutter, slidably inserted in said center head, for scoring said tile, and biasing means for maintaining a constant scoring pressure upon said cutter throughout said scoring operation.

3. An apparatus for scoring and breaking a tile according to claim 1, wherein said center head includes a cutter on a bottom side thereof and a breaker bar on a front side thereof, said breaker bar being closer, than the cutter, to an outer edge of said base proximate a break initiating point on the tile at which breaking is initiated to facilitate said breaking operation.

4. An apparatus for scoring and breaking a tile according to claim 1, said scoring/breaking assembly further comprising:

a single handle for rotating said center head, said handle maintaining said center head against the support member to hold said center head at said constant scoring orientation.

5. An apparatus for scoring and breaking a tile according to claim 1, said scoring/breaking assembly further comprising:

a center track for supporting said scoring/breaking assembly, said center track including at least one cylindrical guide, slidably mounted on said at least one guide rod, for moving said scoring/breaking assembly along said scoring path, said center head being pivotally mounted on said center track, said center track including a cross member which constitutes said support member for maintaining said center head at said constant scoring orientation.

6. An apparatus for scoring and breaking a tile according to claim 1, wherein said center head includes a toe and a back member located on front and back sides thereof, respectively, said toe including a breaker bar for breaking the tile, said back including a recess for releasably holding a handle, wherein a user holds the center head in said constant scoring position throughout said scoring operation by maintaining said back member abutted against said support member.

7. An apparatus for scoring and breaking a tile according to claim 1, wherein said center head includes:

a cutter wheel for scoring the tile, said cutter wheel being inserted through a hole in a bottom of said center head, a tool holder, positioned within and slidable along a cavity in said center head, for holding said cutter wheel, wherein a set screw fastens said cutter wheel to said tool holder, a spring, within said cavity, for continuously and indirectly urging said cutter wheel out of said center head by applying a constant force against said tool holder, and a thumb screw, inserted into a top of said center head and engaging said spring, for changing a scoring pressure by adjusting a compression of said spring.

8. An apparatus for scoring and breaking a tile according to claim 1, wherein said base includes:

a breaker spline mounted within said base and aligned parallel to said scoring path and at a non-zero angle with respect to an upper surface of said base, wherein said non-zero angular relation between said surface creates a shearing force along said scoring path.

9. An apparatus according to claim 8, wherein said upper surface includes a central groove extending therealong in a direction parallel to said scoring path, said breaker spline being snapably fastened within said central groove.

10. An apparatus according to claim 8, wherein said base includes:

resilient pads, affixed to said upper surface of said base and on opposite sides of said breaker spline, and rest plates, fastened to upper surfaces of said resilient pads, for supporting said tile during said scoring and breaking operations, said resilient pads continuously exposing a break point along said breaker spline to said tile by compressing as said scoring/breaking assembly increases a breaking pressure applied to an upper surface of said tile.

11. An apparatus according to claim 1, further comprises a cover having latches integral therewith, said cover enclosing the scoring/breaking assembly, said base and cover being molded from high density polyethylene, said cover including snap-in/out retainers to hold removable parts.

12. An apparatus according to claim 1, further comprises a miter guide arm and miter guide base for adjusting and maintaining the tile at a desired angular relation with respect to the scoring path, said guide arm and guide base being releasably fastened to the base with thumb screws.

13. An apparatus according to claim 12, wherein said miter guide base and miter guide arm are interconnected with a thumb screw and are movable in a direction perpendicular to said scoring path, said miter guide arm being rotatable with respect to said miter guide base.

14. An apparatus for scoring and breaking a tile according to claim 1, wherein said center head includes a toe member containing a breaker bar for breaking said tile, said breaker bar having an exterior surface formed in an inverted V-shape which unevenly contacts said tile.

15. An apparatus for scoring and breaking a tile according to claim 1, wherein said center head is moved in a scoring direction during said scoring operation and wherein said center head includes a breaker bar for breaking said tile and a cutting wheel for scoring said tile, said breaker bar being located at a front toe of said center head in front of said cutting wheel with respect to said scoring direction.

16. An apparatus according to claim 1, wherein said base includes a breaker spline and wherein said scoring/breaking assembly starts said scoring and breaking operations at juxtaposed score and break initiating ends of said base and wherein an upper edge of said breaker spline is aligned substantially even with said upper surface of said base, at said break initiating end, and said upper edge of said breaker spline is below said upper surface of said base, at said score initiating end.

17. An apparatus for scoring and breaking a tile along a scoring path, said apparatus comprising:

a base having an upper surface for supporting said tile during scoring and breaking operations;

at least one guide rod, supported by said base and extending in a direction parallel to said scoring path; and a scoring/breaking assembly, slidably mounted on said at least one guide rod, for scoring and breaking said tile along said scoring path, said base including:

a breaker spline, mounted within said upper surface and aligned parallel to said scoring path and extending downward from one end of said base at an acute angle with respect to said upper surface of said base.

18. An apparatus according to claim 17, wherein said upper surface of said base includes a central groove extending in a direction parallel to said scoring path, said breaker spline being snapably fastened within said central groove and removable therefrom without disassembly of said base.

19. An apparatus according to claim 17, wherein said base includes:

resilient pads, affixed to an upper surface of said base and on opposite sides of said breaker spline, and rest plates, fastened to upper surfaces of said resilient pads, for supporting said tile during said scoring and breaking operations, said resilient pads compressing proximate said scoring/breaking assembly responsive to a breaking pressure applied to an upper surface of said tile to apply a shearing force along said scoring path.

20. An apparatus according to claim 17, further comprises a cover having a latch mounted thereon to connect the cover to the base, said cover enclosing the scoring/breaking assembly, said base and cover being molded from high density polyethylene, said cover including snap-in/out retainers to hold removable parts.

21. An apparatus according to claim 17, further comprises a miter guide arm and miter guide base for adjusting and maintaining said tile at a desired angular relation with respect to the scoring path, said guide arm and guide base being releasably fastened to the base with thumb screws.

22. An apparatus according to claim 21, wherein said miter guide base and miter guide arm are interconnected with a thumb screw and are movable in a direction perpendicular to said scoring path, said miter guide arm being rotatable with respect to said miter guide base.

23. An apparatus according to claim 17, wherein said scoring/breaking assembly includes:

a center head, pivotally connected to said at least one guide rod to rotate between scoring and breaking positions, for scoring and breaking said tile along said scoring path, and a support member for holding said center head at a constant scoring position, with respect to said at least one guide rod, throughout said scoring operation.

24. An apparatus for scoring and breaking a tile according to claim 17, said scoring/breaking assembly further comprising:

a cutter, slidably inserted in said center head, for scoring said tile, and biasing means for maintaining a constant scoring pressure upon said cutter throughout said scoring operation.

25. An apparatus for scoring and breaking a tile according to claim 17, wherein said scoring/breaking assembly includes a breaker bar for breaking said tile, during said breaking operation, said breaker bar applying breaking forces to said tile in directions parallel and perpendicular to the scoring path by moving said breaker bar along the scoring path.

26. An apparatus for scoring and breaking a tile according to claim 17, wherein said scoring/breaking assembly includes a cutter wheel on a bottom side thereof and a breaker bar on a front side thereof, when said scoring/breaking assembly is located at a break-initiating end of the base, said breaker bar being located closer, than said cutter wheel, to an outer edge of said base to facilitate the breaking operation.

27. An apparatus for scoring and breaking a tile according to claim 16, said scoring/breaking assembly further comprising:

a center track for supporting said scoring/breaking assembly, said center track including at least one cylindrical guide, slidably mounted on said at least one guide rod, for slidably moving said scoring/breaking assembly along said scoring path, and a center head pivotally mounted to said center track, said center track including a cross member for maintaining said center head in a constant angular position with respect to said center track throughout said scoring operation.

28. An apparatus for scoring and breaking a tile according to claim 17, wherein said scoring/breaking assembly includes a toe member and a back member on front and back sides thereof, respectively, said toe member including a breaker bar having an inverted V-shape for breaking said tile, said back member including a recess for releasably holding a handle, wherein a user maintains said scoring/breaking assembly in a constant scoring angular position with respect to said upper surface of said base during a scoring operation by holding said back member in an abutting relation against said support member.

29. An apparatus for scoring and breaking a tile according to claim 17, wherein said scoring/breaking assembly comprises:

a cutter pivotally, mounted to said at least one guide rod, for scoring said tile; and means for maintaining said cutter in a predetermined angular orientation with respect to said at least one guide rod throughout said scoring operation.

30. An apparatus according to claim 17, wherein said scoring/breaking assembly starts said scoring and breaking operations at juxtaposed score and break initiating ends of said base and, said breaker spline being aligned such that an upper edge thereof is aligned substantially even with said upper surface of said base at said break initiating end and said upper edge of said breaker spline is below said upper surface of said base at said score initiating end.

31. An apparatus for scoring a tile along a scoring path, said apparatus comprising:

a base for holding said tile during a scoring operation;

a scoring assembly; and support means for slidably mounting said scoring assembly to said base, said scoring assembly including:

a center head, pivotally mounted to said support means to rotate to and from a scoring position, for scoring said tile along said scoring path, and abutment means, rigidly mounted to said support means, for abutting against said center head to maintain said center head at a constant scoring distance from said base throughout said scoring operation.

32. An apparatus for scoring a tile according to claim 31, wherein said base includes:

a breaker spline for breaking said tile extending parallel to said scoring path and downward from a break initiating end of said base at a non-zero angle to a surface of said base.

33. An apparatus for scoring a tile according to claim 31, wherein said base includes a breaker spline and wherein said scoring assembly includes breaker means for breaking said tile, said scoring assembly starting scoring and breaking operations at juxtaposed score and break initiating ends of the tile and wherein, at said break initiating end, an upper surface of said breaker means is substantially even with an upper surface of said base and, at said score initiating end, said upper surface of said breaker means is below said upper surface of said base.

* * * * *